US008641165B2

(12) United States Patent
Shimizu et al.

(10) Patent No.: US 8,641,165 B2
(45) Date of Patent: Feb. 4, 2014

(54) INKJET IMAGE RECORDER AND METHOD FOR CORRECTION OF BELT CONVEYANCE

(75) Inventors: Keigo Shimizu, Kyoto (JP); Tatsuki Tahara, Kyoto (JP)

(73) Assignee: Dainippon Screen Mfg. Co. Ltd. (JP)

( * ) Notice: Subject to any disclaimer, the term of this patent is extended or adjusted under 35 U.S.C. 154(b) by 124 days.

(21) Appl. No.: 13/499,178

(22) PCT Filed: Jun. 22, 2010

(86) PCT No.: PCT/JP2010/060526
§ 371 (c)(1),
(2), (4) Date: Mar. 29, 2012

(87) PCT Pub. No.: WO2011/040098
PCT Pub. Date: Apr. 7, 2011

(65) Prior Publication Data

US 2012/0182347 A1 Jul. 19, 2012

(30) Foreign Application Priority Data

Sep. 29, 2009 (JP) ..... 2009-223579

(51) Int. Cl.
*B41J 29/393* (2006.01)

(52) U.S. Cl.
USPC ..... 347/19

(58) Field of Classification Search
USPC ..... 347/5, 8, 19
See application file for complete search history.

(56) References Cited

U.S. PATENT DOCUMENTS 6,557,991 B2 * 5/2003 Koitabashi et al. ..... 347/101
8,328,192 B2 * 12/2012 Yamazaki et al. ..... 271/265.04
2006/0165442 A1 7/2006 Kobayashi et al.
2006/0237895 A1 10/2006 Nishikata et al.
2007/0139459 A1 6/2007 Furuya

FOREIGN PATENT DOCUMENTS

JP 62-242964 10/1987
JP 5-2347 1/1993
JP 10-231041 9/1998
JP 2004-276425 10/2004

(Continued)

OTHER PUBLICATIONS

Corresponding Japanese Patent Application 2009-223579, Office Action dated Apr. 30, 2013.

*Primary Examiner* — Lamson Nguyen
(74) *Attorney, Agent, or Firm* — Ostrolenk Faber LLP

(57) ABSTRACT

Provided are an ink-jet image recorder for recording an image precisely and a method for correction of belt conveyance mechanisms by controlling the roller drive on the basis of fluctuation of the conveyance rate caused by a particular failure in the endless belt. In the belt conveyor mechanism of the ink-jet image recorder, the method for correction of the belt conveyance comprises a position detection step (Step S1) for detecting a specified position on the endless belt; a measurement step for measuring the rotation rate of the roller; a position calculation step (Step S4) for specifying a position on the endless belt; a calculation step (Step S5) for calculating the corrected conveyance rate; in the error-causing region where a conveyance error is caused by the endless belt during movement of the endless belt, by addition to the position of the endless belt, of the amount of correction of the conveyance rate of the endless belt calculated from the conveyance error corresponding to the error-causing region; and a driving rate calculation step (Step S6) for adjusting the motor driving rate in accordance with the corrected conveyance rate.

5 Claims, 7 Drawing Sheets

(56) References Cited

FOREIGN PATENT DOCUMENTS

| | | |
|---|---|---|
| JP | 2006-154289 | 6/2006 |
| JP | 2006-235560 | 9/2006 |
| JP | 2006-306538 | 11/2006 |
| JP | 2007-168174 | 7/2007 |
| JP | 2009-86653 | 4/2009 |

* cited by examiner (a)

(b)

INKJET IMAGE RECORDER AND METHOD FOR CORRECTION OF BELT CONVEYANCE

CROSS REFERENCE TO RELATED APPLICATIONS

The present application is a 35 U.S.C. §371 national phase conversion of PCT/JP2010/060526 filed Jun. 22, 2010 and claims priority of JP2009-223579 filed Sep. 29, 2009, both incorporated herein in their entirety.

TECHNICAL FIELD

The present invention relates to an inkjet image recorder that records an image on a recording material by, in main and sub scanning directions, relatively moving the recording material conveyed by a belt conveyance mechanism and a recording head.

BACKGROUND ART

In such an inkjet image recorder, as a conveyance mechanism for a printing material, there is employed a belt conveyance mechanism that conveys a recording material in a direction orthogonal to a moving direction of a recording head by, in a state where the recording material is sucked and held on an endless belt wound on a pair of rollers including a driving motor and a driven motor, driving the driving roller.

In a system that performs printing while moving a printing material relative to the recording head by the belt conveyance mechanism, a conveyance error of the printing material is one of causes for printing unevenness. For this reason, in order to achieve stable conveyance of the printing material, there is proposed an image recorder that measures a variation in belt conveyance rate due to eccentricity of a driving roller, and on the basis of correction data based on a value obtained by the measurement, controls rotation of the driving roller (see Patent literature 1).

Further, there is also proposed an image recorder that is, in order to reduce a variation in belt conveyance rate due to, in addition to eccentricity of a driving roller, a change in thickness of an endless belt, provided with means adapted to measure a change in length from a rotating center of the driving roller to a belt surface of the endless belt, and on the basis of the change, controls rotation of the driving roller (see Patent literature 2).

CITATION LIST

Patent Literature

Patent literature 1: JPA 2004-276425
Patent literature 2: JPA 2006-306538

SUMMARY OF INVENTION

Technical Problem

Meanwhile, an endless belt is formed in an endless shape by, for example, joining end pars of a sheet-like material such as a mesh material to each other. When a joint comes to a position of a roller during movement of the endless belt, catching or the like between the joint and the roller occurs to cause a variation in conveyance rate of the endless belt. In particular, when the joint is brought into contact with or separated from any of a pair of rollers during one-time rotation of the endless belt, the occurrence of a large variation in conveyance rate is found. Controlling rotation of a driving roller in order to reduce such a variation in belt conveyance rate that is, as described, caused in a certain region within one-time rotation of the endless belt by some specific failure such as the joint of the belt or local damage of the belt has not been performed previously.

The present invention is made in order to solve the above problem, and has an object to provide an inkjet image recorder and a method for correction of belt conveyance that can properly perform image recording by controlling roller driving on the basis of a variation in conveyance rate caused by a specific failure of an endless belt.

Solution to Problem

A first aspect of the present invention is an inkjet recorder that relatively moves a recording material and a recording head to thereby record an image on the recording material, and provided with: a belt conveyance mechanism having an endless belt that is wound on a pair of rollers to thereby form an upper traveling part and a lower traveling part, and a motor that rotates one of the pair of rollers to thereby move the endless belt in a specified direction; a position detecting device adapted to detect a specified position on the endless belt; a measurement device adapted to measure a rotation rate of at least one roller of the pair of rollers; a position calculating means adapted to, from a measurement value measured by the measurement device, on the basis of a moving distance of the specified position, the moving distance being detected by the position detecting device, specify a position on the endless belt; a correction amount calculating means adapted to, during the movement of the endless belt, in an error-causing region where an conveyance error is caused by the endless belt, on the basis of the conveyance error, calculate a conveyance correction amount for correcting a conveyance error of the endless belt; a corrected conveyance rate calculating means adapted to adding the conveyance correction amount to a position on the endless belt, the position being related to the error-causing region, to thereby calculate a corrected conveyance rate; and a driving rate calculating means adapted to adjust a driving rate of the motor according to the corrected conveyance rate.

A second aspect of the present invention is the invention as defined in the first aspect of the present invention wherein the specified position is a position of a marker formed in a location that is on a belt member of the endless belt and has a certain positional relationship with a joint.

A third aspect of the present invention is the invention as defined in the first aspect of the present invention wherein the error-causing region is a region including a position on the endless belt, the position being where a joint of a belt member of the endless belt is brought into abutting contact with any of the pair of rollers or separated from any of the pair of rollers.

A fourth aspect of the present invention is the invention as defined in the third aspect of the present invention wherein the endless belt has a scale along a moving direction in an end part in a main scanning direction thereof; and an imaging device adapted to image the scale is further provided.

A fifth aspect of the present invention is a method for correction of belt conveyance in a belt conveyance mechanism having an endless belt that is wound on a pair of rollers to thereby form an upper traveling part and a lower traveling part, and a motor that rotates one of the pair of rollers to thereby move the endless belt in a specified direction, and provided with: a position detection step for detecting a specified position on the endless belt; a measurement step for measuring a rotation rate of at least one roller of the pair of rollers; a position calculation step for, from a measurement value measured by the measurement step, on the basis of a moving distance of the specified position, the moving distance being detected by the position detection step, specifying a position on the endless belt; a correction amount calculation step for, during the movement of the endless belt, in an error-causing region where a conveyance error is caused by the endless belt, on the basis of the conveyance error, calculating a conveyance correction amount for the endless belt; a corrected conveyance rate calculation step for adding the conveyance correction amount to a position on the endless belt, the position being related to the error-causing region, to thereby calculate a corrected conveyance rate; and a driving rate calculation step for adjusting a driving rate of the motor according to the corrected conveyance rate.

A sixth aspect of the present invention is the invention as defined in the fifth aspect of the present invention wherein the specified position is a position of a marker formed in a location that is on a belt member of the endless belt and has a certain positional relationship with a joint.

A seventh aspect of the present invention is the invention as defined in the fifth aspect of the present invention wherein the error-causing region is a region including a position on the endless belt, the position being where a joint of a belt member of the endless belt is brought into abutting contact with any of the pair of rollers or separated from any of the pair of rollers.

Advantageous Effects of Invention

According to the first to fifth aspects of the present invention, in the error-causing region where an conveyance error is caused by the endless belt, the correction amount calculation that calculates a conveyance correction amount, corrected conveyance rate calculation that calculates a corrected conveyance rate, and driving rate calculation that adjusts a driving rate of the motor are performed, so that a range required to be corrected can be set to efficiently perform calculation processes, and while reducing a time spent for adjustment work for recording a proper image, the image can be accurately recorded.

According to the second to sixth aspects of the present invention, the marker is formed near the joint of the belt member of the endless belt, so that highly precise position alignment can be easily performed, and also the error-causing region can be accurately specified.

According to the third to seventh aspects of the present invention, the error-causing region is a region including a position on the endless belt where the joint of the belt member of the endless belt is brought into abutting contact with any of the pair of rollers or separated from any of the pair of rollers, so that the belt conveyance rate can be corrected with focusing on such regions, and therefore recording unevenness or the like of an image can be quickly solved.

According to the fourth aspect of the present invention, at the time of actual image recording, the scale added to the endless belt is monitored by the imaging device, and therefore by examining whether or not the driving rate of the motor has been adjusted according to the corrected conveyance rate, a high quality image recording state can be maintained.

DESCRIPTION OF EMBODIMENTS

Figure 1:
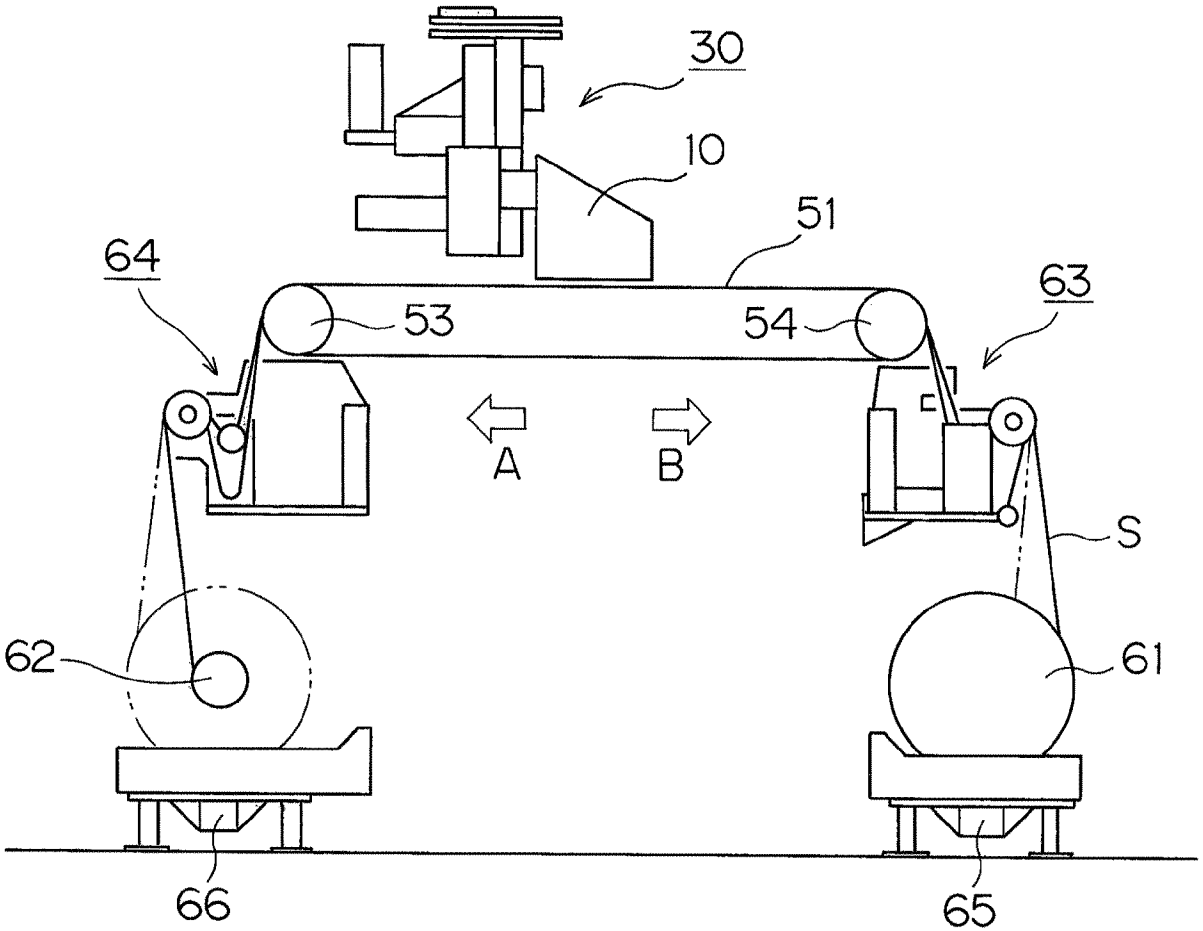
FIG. 1 is a schematic front view of an inkjet image recorder according to a first embodiment of the present invention.

Embodiments of the present invention will hereinafter be described on the basis of the drawings. FIG. 1 is a schematic front view of an inkjet image recorder according to the present invention, and FIG. 2 is a perspective view of it.

Figure 2:
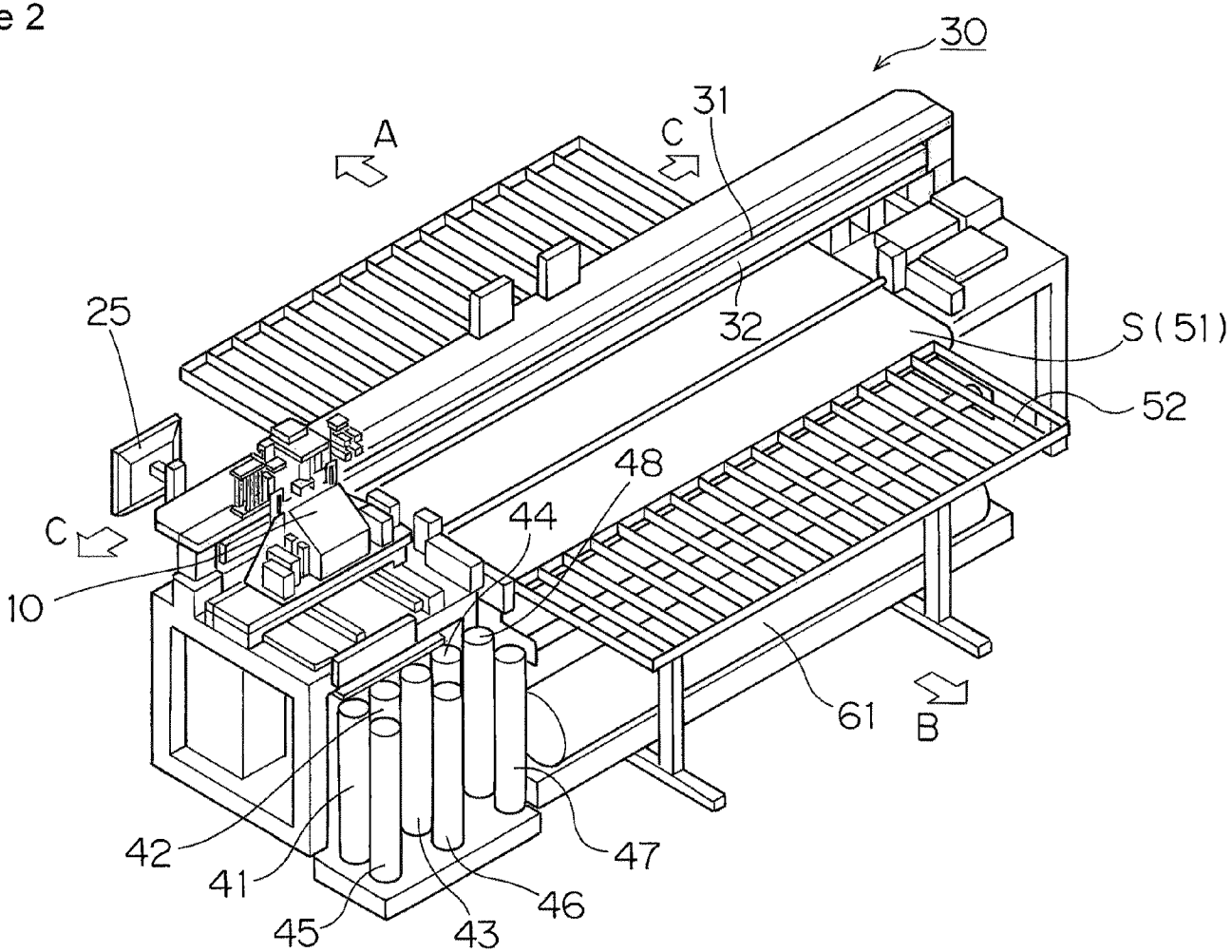
FIG. 2 is a perspective view of the inkjet image recorder according to the first embodiment of the present invention.

The inkjet image recorder is one that records an image on a long-sized or plate-like recording material S by moving the recording material S in a sub scanning direction indicated by a symbol A or B in FIGS. 1 and 2, and also using a recording head moving mechanism 30 to move a recording head 10 in a main scanning direction that is indicated by a symbol C in FIG. 2 and orthogonal to the sub scanning direction. Note that FIGS. 1 and 2 illustrate a state where an image is recorded on the long-sized roll-like recording material S.

Referring to FIG. 1, a porous (so-called mesh material) endless belt 51 is wound on a pair of rollers 53 and 54. Note that the pair of rollers 53 and 54 and the endless belt 51 constitute a belt conveyance mechanism. In the endless belt 51, upper and lower traveling parts are formed. A surface of the upper traveling part, which comes into contact with the recording material S, can suck and hold the recording material S by an unillustrated suction mechanism. Also, the roller 53 of the pair of rollers 53 and 54 is a driving roller, and the roller 54 is a driven roller. The roller 53 is connected with an after-mentioned motor 55 that can rotate in forward and backward directions, and can therefore move the upper traveling part of the endless belt 51 in any of the directions respectively indicated by the arrows A and B. The recording material S is wound out of a first roller 61 that rotates by driving of a motor 65, and through a tension adjustment mechanism 63, moves with being sucked and held by the upper traveling part of the porous endless belt 51. Then, the recording material S is, through a tension adjustment mechanism 64, rewound by a second roller 62 that rotates by driving of a motor 66. In this case, the recording material S moves in the direction indicated by an arrow A illustrated in FIGS. 1 and 2.

On the other hand, in the case where the first and second rollers 61 and 62 rotate in the backward direction, the recording material S is wound out of the second roller 62, and through the tension adjustment mechanism 64, moves with being sucked and held by the porous endless belt 51. Then, the recording material S is wound by the first roller 61 through the tension adjustment mechanism 63. In this case, the recording material S moves in the direction indicated by an arrow B illustrated in FIGS. 1 and 2.

In addition, in the inkjet image recorder, instead of the soft long-sized recording material S, a hard plate-like recording material or a soft plate-like recording material referred to as a sheet of paper can also be used. In this case, an auxiliary table 52 illustrated in FIG. 2 is used when such a recording material is sucked and held by the endless belt 51. The auxiliary table 52 is adjusted such that an upper surface height thereof is positioned in the same plane as the upper traveling part of the endless belt 51. Also, as described above, the roller 53 is the driving roller, and connected with the motor 55 that can rotate in the forward and backward directions, and therefore with use of driving force of the motor 55, the hard plate-like recording material or the recording material referred to as a sheet of paper that is sucked and held by the endless belt 51 can be moved in the sub scanning direction.

As illustrated in FIG. 2, the inkjet image recorder is provided with a touch panel type input/output part 25. Data necessary for image recording by the inkjet image recorder is inputted through the input/output part 25 and then displayed.

Also, the inkjet image recorder is one that uses yellow, magenta, cyan, black, light cyan, light magenta, and white inks to perform multicolor printing. The inkjet image recorder is, as illustrated in FIG. 2, provided with a yellow ink tank 44, a magenta ink tank 43, a cyan ink tank 42, a black ink tank 41, a light cyan ink tank 46, a light magenta ink tank 45, a white ink tank 47, and a cleaning liquid tank 48.

Figure 3:
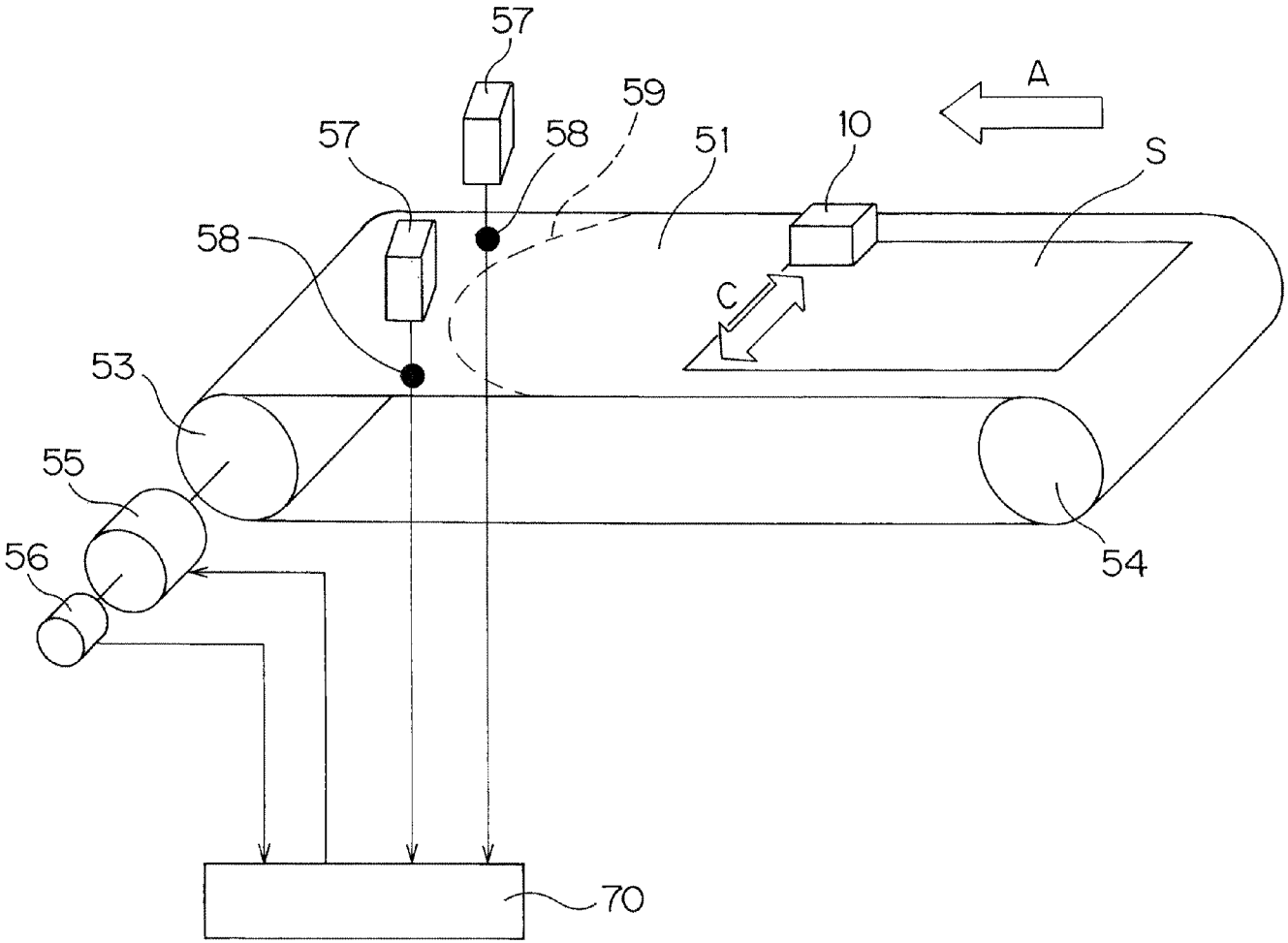
FIG. 3 is an explanatory diagram for explaining conveyance operation of a recording material in a belt conveyance mechanism.

FIG. 3 is an explanatory diagram illustrating conveyance operation of a recording material in the belt conveyance mechanism. In addition, FIG. 3 illustrates the case of using a plate-like recording material S. Further, an arrow A and a symbol C in the diagram indicate a moving direction of the endless belt 51 and a moving direction of the recording head 10 respectively.

As illustrated in FIG. 3, the endless belt 51 has a belt joint 59. The joint 59 is of a linear shape before the endless belt 51 is loaded on the pair of rollers 53 and 54 because when the mesh material as a belt member is joined with a fine wire or the like and thereby formed in the endless shape, the joining is linearly performed along linear end parts of the mesh material. However in the course of rotating the endless belt 51 loaded on the pair of rollers 53 and 54, the shape of the joint 59 is deformed into a U-shape, and then stabilized in the shape. Accordingly, in FIG. 3, the shape of the joint 59 is illustrated as the U-shape. Further, the endless belt 51 has markers 58 serving as start and end point marks of one rotation of the moving endless belt 51 at positions that are adjacent to the joint 59 and on the traveling direction side indicated by the arrow A. In addition, the markers 58 are formed at two positions that are locations respectively having certain positional relationships with the joint 59 and near both end pars in the main scanning direction on the endless belt 51.

Also, the inkjet image recorder is provided with: the motor 55 for driving the roller 53; an encoder 56 that measures a rotation rate of the roller 53; position sensors 57 that detect the markers 58; and a control part 70. The control part 70 is provided with: a CPU that performs a logical operation; a ROM that stores a control program; and a RAM that stores image data and the like, and controls a whole of the recorder. Further, as illustrated in FIG. 3, the control part 70 is connected to the motor 55, the encoder 56, and the position sensors 57.

The position sensors 57 are disposed in two positions above the endless belt 51 such that when the endless belt 51 moves, the markers 58 pass just below the position sensors 57. When the position sensors 57 detect the markers 58, corresponding signals are transmitted to the control part 70.

The encoder 56 is connected to the motor 55, and measures an actual driving rate of the motor 55 to thereby indirectly measure the rotation rate of the roller 53 connected to the motor 55. A value measured by the encoder 56 is transmitted to the control part 70.

The control part 70 having received the signals from the encoder 56 and the position sensors 57 generates a drive signal for the motor 55 on the basis of the signals, and the drive signal is transmitted to the motor 55.

In the case of performing image recording in the inkjet image recorder having a configuration as described above, when the recording head 10 moves above the printing material S in the main scanning direction, the endless belt 51 is in a stopped state. Also, every time the recording head 10 finishes moving one time in the main scanning direction, the roller 53 is rotated by a specified amount to move the endless belt 51. By repeating the stop and movement of the endless belt 51, the belt conveyance mechanism conveys the recording material S in the direction indicated by the arrow A.

Figure 4:
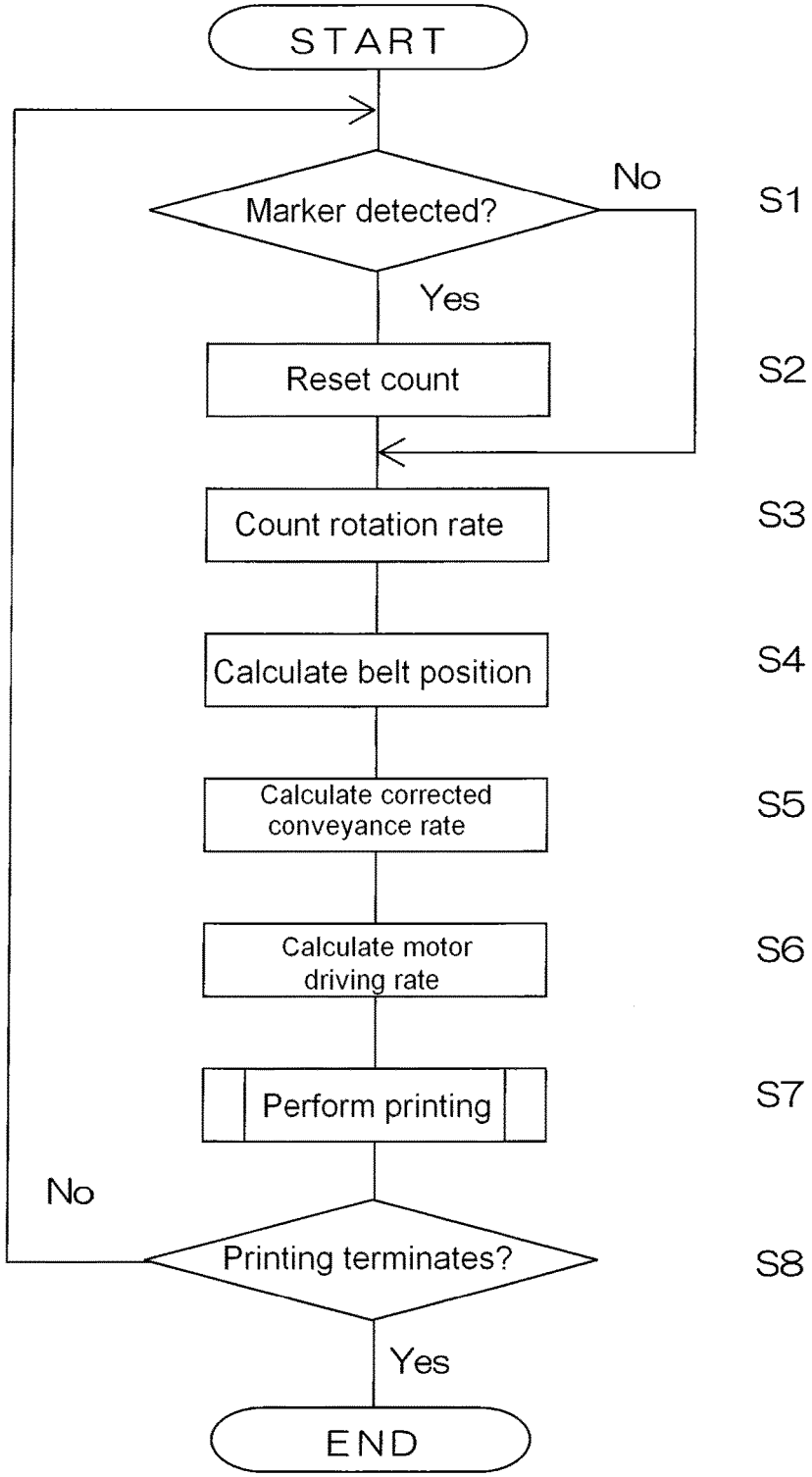
FIG. 4 is a flowchart illustrating a method for correcting the belt conveyance mechanism.
Figure 5:
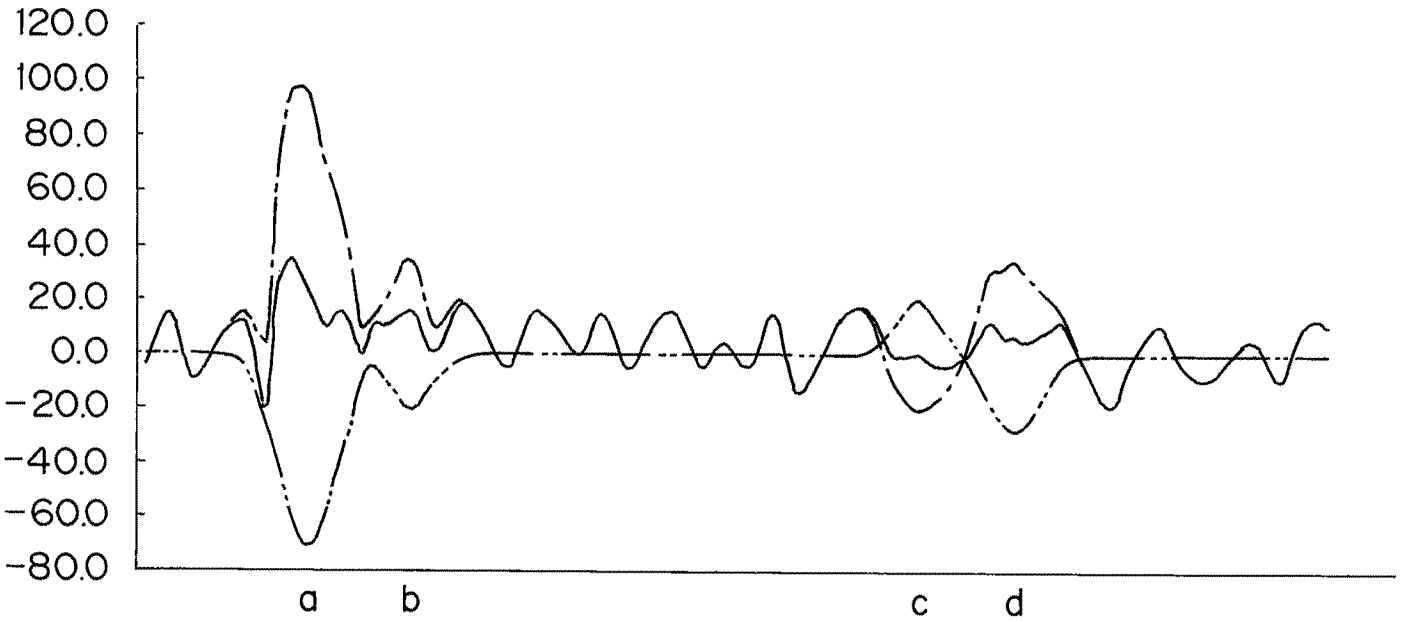
FIG. 5 is a graph explaining a relationship between a conveyance error of an endless belt 51 and a correction amount.
Figure 6:
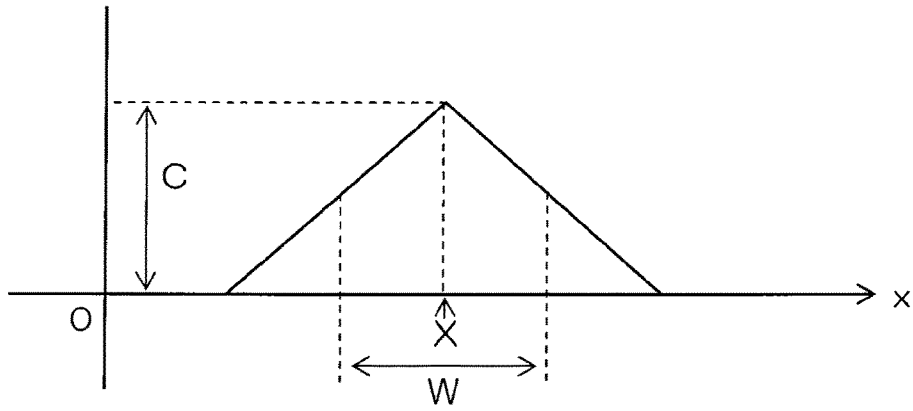
FIG. 6 is an explanatory diagram illustrating an example of conveyance correction amount calculation for the endless belt 51.
Figure 6:
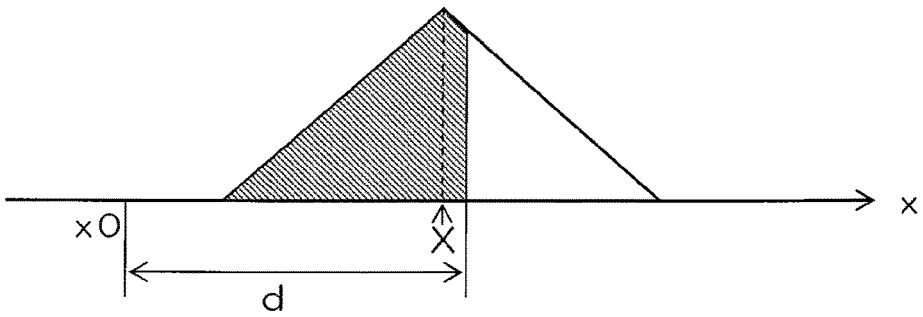

Next, a method for correcting the belt conveyance mechanism in the inkjet image recorder is described. FIG. 4 is a flowchart illustrating the method for correcting the belt conveyance mechanism according to the present invention. FIG. 5 is a graph explaining a relationship between a conveyance error of the endless belt and a correction amount, and FIG. 6 is an explanatory diagram illustrating an example of corrected conveyance rate calculation for the endless belt 51.

First, along with the start of printing, movement of the endless belt 51 is started, and if the position sensors 57 detect the markers 58 on the endless belt 51 illustrated in FIG. 3 (Step S1), a pulse count from the encoder 56 is once reset (Step S2). As described above, the markers 58 serve as the start and end point marks of one rotation of the endless belt 51. For this reason, by resetting the pulse count from the encoder 56, zero point alignment of the start point of one rotation of the endless belt 51 is performed at the positions of the markers 58. On the other hand, if the position sensors 57 do not detect the markers 58, the count of the encoder 56 is accumulated without being reset.

When the pulse count of the encoder 56 is reset (Step S2), pulse counting is again started from there (Step S3). The encoder 56 is connected to the roller 53 through the motor 55, and therefore the control part 70 stores a signal received from the encoder 56 as a count for a rotation rate of the roller 53. Then, from the rotation rate of the roller 53, a moving distance of the markers 58, that is, a belt position of the endless belt 51 for the case of using the markers 58 as the start point is calculated (Step S4).

After that, an after-mentioned error-causing region where a conveyance error is caused by the endless belt and the belt position is related to each other, and on the basis of the conveyance error, which is also described later, a corrected conveyance rate of the endless belt 51, which is added with a conveyance correction amount for correcting the conveyance error, is calculated (Step S5).

Here, the error-causing region where a conveyance error is caused by the endless belt, and the conveyance correction amount are further described.

The error-causing region and the conveyance correction amount are set by the following procedure. Referring to FIG. 3 again, first, the printing paper S is arranged in a specified position that is on an upstream side of the markers 58 with respect to the moving direction (direction indicated by the arrow A) of the endless belt 51. Then, a test pattern for measuring printing unevenness is printed on the printing paper S. The specified position here refers to a position where the test pattern is printed on the printing paper S by the printing head 10 when the joint 59 of the endless belt 51 is in a position of being brought into contact with the roller 53 and/or the roller 54, and in a position of being separated from the roller 53 and/or the roller 54.

The test pattern printed in this manner is observed with a microscope or the like to calculate the conveyance error of the endless belt 51, which appears as the printing unevenness.

Every time the recording head 10 finishes moving one time in the main scanning direction, the inkjet image recorder rotates the roller 53 by the specified amount, and repeats operation of moving the endless belt 51 by the specified amount. For this reason, a difference in length between a preliminarily set moving amount (moving distance) of the endless belt 51 and a sub scanning direction width of an image formed by the one-time movement of the recording head 10 in the main scanning direction in the test pattern is set as the conveyance error. The conveyance error can be represented as a waveform indicated by a dashed-dotted line in the graph of FIG. 5. In addition, in FIG. 5, the vertical axis represents the conveyance error and conveyance correction amount (μm), and the horizontal axis represents a position on the endless belt 51 for the case of using the positions of the markers 58 as the start point.

Meanwhile, in the graph of FIG. 5, there are regions where amplitude of the waveform indicated by the dashed-dotted line appears to be large relative to the other region. The regions of the endless belt 51 where the conveyance error is large are set as the error-causing regions in the present invention. Here, a symbol a in FIG. 5 indicates a region where before the endless belt 51 moves and consequently the joint 59 moves from the upper traveling part to the lower traveling part, the joint 59 is brought into abutting contact with an upper end of the roller 53 serving as the driving roller, and a symbol b indicates a region where after having moved along with the rotation of the roller 53, the joint 59 is separated from a lower end of the roller 53. A symbol c in FIG. 5 indicates a region where before the endless belt 51 moves and consequently the joint 59 moves from the lower traveling part to the upper traveling part, the joint 59 is brought into abutting contact with a lower end of the roller 54 serving as the driven roller, and a symbol d indicates a region where after having moved along with the rotation of the roller 54, the joint 59 is separated from an upper end of the roller 54. As described, each of the error-causing regions is also a region including a position on the endless belt 51 where the joint 59 of the belt member of the endless belt 51 is brought into abutting contact with any of the pair of rollers 53 and 54, or separated from any of the pair of rollers 53 and 54. If a relationship between each of the error-causing regions and a corresponding cause is clarified, it is only necessary to perform test pattern printing in a range where the test pattern in the error-causing region is obtained, so that printing paper, ink, and the like can be saved, and also an information processing time can be shortened.

A conveyance correction amount in each of the error-causing regions is obtained by, from a peak height, a peak width, and the like in the error-causing region, setting a correction function F(x) for a corresponding conveyance error graphed in FIG. 5, and further performing a calculation process using the correction function F(x).

FIGS. 6(*a*) and (*b*) schematically illustrates an example of the correction function F(x) and a conveyance correction amount obtained by using the correction function F(x), respectively, with relationships with a peak height, a peak width, and the like of the graph in an error-causing region being clear. In addition, as in FIG. 5, in FIG. 6, the vertical axis represents a conveyance error and a conveyance correction amount (μm), and the horizontal axis represents a position on the endless belt 51 in the sub scanning direction for the case of using the positions of the markers 58 as the start point.

In the correction function F(x), first, from the graph indicated in FIG. 5 by the dashed-dotted line, a correction position X is extracted. The correction position X is, as illustrated in FIG. 6(*a*), set to a position where in the case where a value in the error-causing region is a positive value, the peak height of the graph is highest. Also, on the assumption that a peak shape of the graph in the error-causing region is a normal distribution shape, the correction position X corresponds to a median in the region required to be corrected, that is, a median in a correction range corresponding to the peak width of the graph. Here, assuming that the correction amount is denoted by C, a half width of the correction range by W, and a position on the endless belt 51 serving as a start point of some one-time conveyance of the endless belt 51 by x, which corresponds to one-time movement of the recording head 10, the correction function F(x) in the case where x is (X−W) or more and less than X is expressed by the following expression (1):

[Expression 1]

$$F(x) = C \cdot \left(\frac{x - X}{W} + 1\right) \tag{1}$$

Also, in the case where x is X or more and (X+W) or less, the correction function F(x) is expressed by the following expression (2):

[Expression 2]

$$F(x) = -C \cdot \left(\frac{x - X}{W} - 1\right) \tag{2}$$

Note that, as expressed by the expressions (1) and (2), in the cases where x is in the ranges respectively smaller than and not less than the correction position X of the graph peak illustrated in FIG. 6(*a*), the correction functions are separately set. This is, as indicated by hatching in FIG. 6(*b*), to relate the correction function to the case where a one-time conveyance rate d of the endless belt 51 corresponding to the one-time movement of the recording head 10 does not include a whole of the correction range, that is, the correction range is divided by two-time or more conveyance. Also, the correction position X, the correction amount C, the half width W of the correction range are values obtained from a conveyance error that is obtained from a printed test pattern; however, in the case of printing the test pattern several times, these values are not corresponding average values but determined by a statistical method on the basis of a peak shape and a width of a graphed conveyance error.

An expression for adding the conveyance correction amount obtained from these correction functions F(x) to obtain a corrected conveyance rate D(x0) is, in the case of conveyance by a distance d from x=x0, expressed by the following expression (3):

[Expression 3]

$$D(x0) = d + \int_{x=x0}^{x0+d} F(x)\,dx \tag{3}$$

If two or more graph peaks in error-causing regions are present within a range defined by a one-time conveyance rate of the endless belt 51 corresponding to the one-time movement of the recording head 10, a process such as further averaging values obtained by the above-described expressions (1) to (3) is performed on each of the peaks to be thereby able to obtain the corrected conveyance rate. Note that the above-described correction functions F(x) and calculation expression for the corrected conveyance rate are not limited to themselves, but applicable with any of a sine function, a cosine function, and other linear and nonlinear functions.

The corrected conveyance rate obtained for the error-causing region with use of the above-described expressions is represented by a graph indicated by a dashed-two dotted line in FIG. 5. Looking at the positions indicated by the symbols a, b, c, and d, it turns out that the correction amounts (values of the vertical axis in the graph of FIG. 5) of the corrected conveyance rates have a phase that is substantially opposite to that of the conveyance errors before the correction.

Referring to FIG. 4 again, on the basis of the corrected conveyance rate obtained in Step S5, the driving rate of the motor 55 connected to the roller 53 serving as the driving roller is calculated (Step S6). After that, printing is performed while driving the motor 55 according to the obtained driving rate of the motor 55 (Step S7). After the printing has terminated (Step S8), the correction of the belt conveyance mechanism also terminates.

The actual conveyance rate and conveyance error of the endless belt 51 after the correction of the belt conveyance mechanism are represented by a waveform indicated by a solid line in the graph of FIG. 5. Looking at this, it turns out that by the above-described correction of the belt conveyance mechanism, the amplitude of the waveform of the conveyance error falls within an allowable range where the printing unevenness is unnoticeable.

Figure 7:
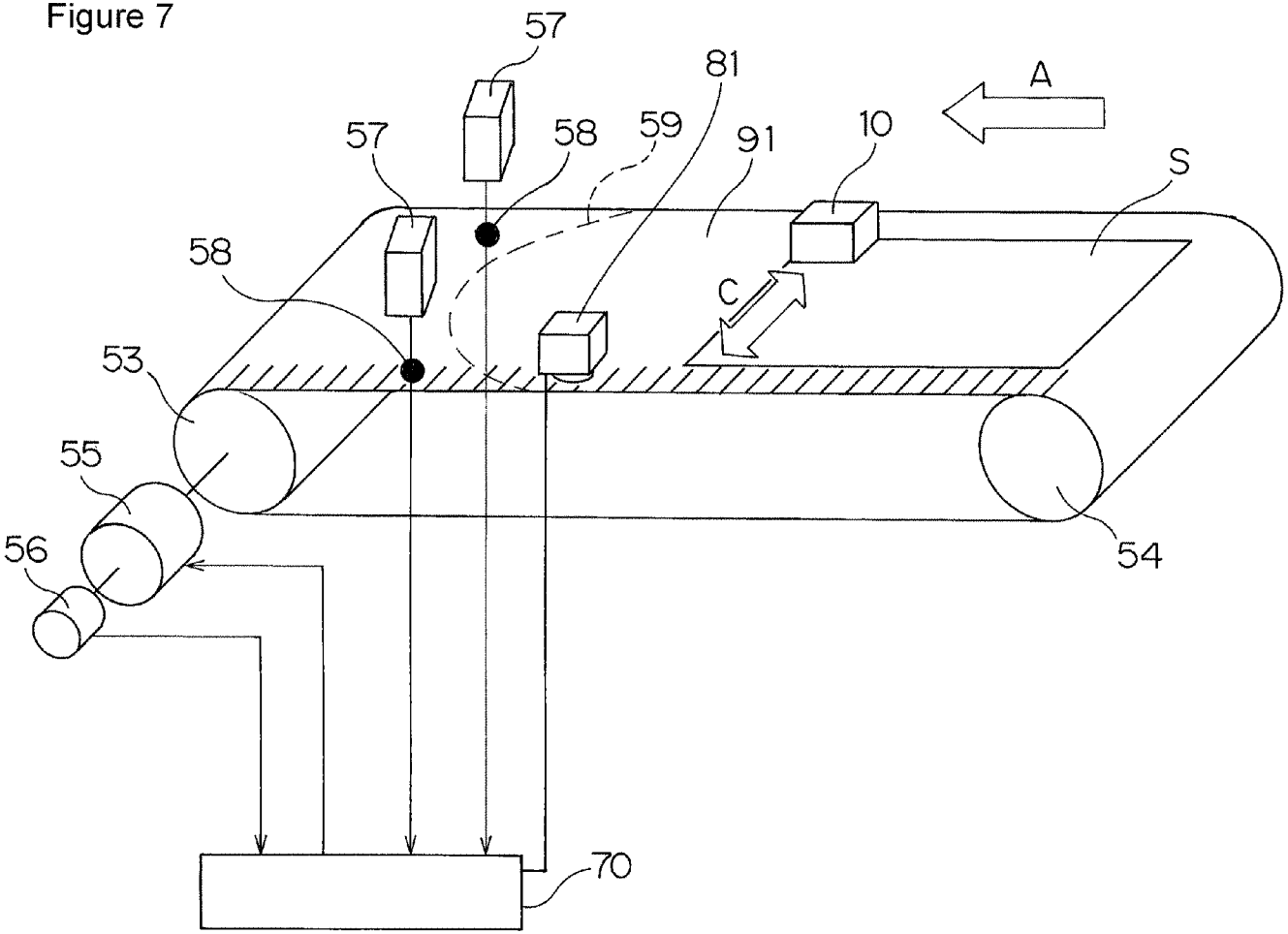
FIG. 7 is an explanatory diagram for explaining conveyance operation of a recording material in a belt conveyance mechanism according to another embodiment.

Next, a belt conveyance mechanism according to another embodiment is described. FIG. 7 is an explanatory diagram for explaining conveyance operation of a recording material in the belt conveyance mechanism according to another embodiment. The same components as those in the above-described embodiment are added with the same symbols to omit detailed description thereof.

In this embodiment, in place of the endless belt 51, the belt conveyance mechanism is provided with an endless belt 91 that has a scale along a moving direction in an end part in a main scanning direction thereof, and further provided with an imaging part 81 that images the scale.

In this inkjet image recorder, by adding the scale to the endless belt 91, and monitoring not the printed test pattern but the scale with the imaging part 81 at the time of actual image printing, an effect of correction on a driving rate of a motor adjusted according to a corrected conveyance rate can be examined.

REFERENCE LIST

10: Recording head
30: Recording head moving mechanism
51: Endless belt
53: Roller
54: Roller
55: Motor
56: Encoder
57: Position sensor
58: Marker
59: Joint
61: First roller
62: Second roller
63: Tension adjustment mechanism
64: Tension adjustment mechanism
70: Control part
81: Imaging part
91: Endless belt
S: Recording material

The invention claimed is:

1. An inkjet image recorder that relatively moves a recording material and a recording head to thereby record an image on the recording material, the inkjet image recorder comprising:

a belt conveyance mechanism having an endless belt that is wound on a pair of rollers to thereby form an upper traveling part and a lower traveling part, and a motor that rotates one of the pair of rollers to thereby move the endless belt in a specified direction;

position detecting device adapted to detect a specified position on the endless belt;

measurement device adapted to measure a rotation rate of at least one roller of the pair of rollers;

a controller comprising a processor and a memory, said controller being programmed so as to calculate a position, from a measurement value measured by the measurement device, on a basis of a moving distance of the specified position, the moving distance being detected by the position detecting device, to specify a position on the endless belt;

calculate a conveyance correction amount, during the movement of the endless belt, in an error-causing region where an conveyance error is caused by the endless belt, on a basis of the conveyance error, for correcting a conveyance error of the endless belt;

calculate a corrected conveyance rate by adding the conveyance correction amount to a position on the endless belt, the position being related to the error-causing region, to thereby calculate a corrected conveyance rate; and calculate a driving rate, to adjust a driving rate of the motor according to the corrected conveyance rate; wherein the error-causing region is a region including a position on the endless belt, the position being where a joint of a belt member of the endless belt is brought into abutting contact with any of the pair of rollers or separated from any of the pair of rollers.

2. The inkjet image recorder according to claim 1, wherein the specified position is a position of a marker formed in a location that is on a belt member of the endless belt and has a certain positional relationship with a joint.

3. The inkjet image recorder according to claim 1, wherein:

the endless belt has a scale along a moving direction in an end part in a main scanning direction thereof; and imaging device adapted to image the scale is further provided.

4. A method for correction of belt conveyance in a belt conveyance mechanism having an endless belt that is wound on a pair of rollers to thereby form an upper traveling part and a lower traveling part, and a motor that rotates one of the pair of rollers to thereby move the endless belt in a specified direction, the method comprising:

a position detection step for detecting a specified position on the endless belt;

a measurement step for measuring a rotation rate of at least one roller of the pair of rollers;

a position calculation step for, from a measurement value measured by the measurement step, on a basis of a moving distance of the specified position, the moving distance being detected by the position detection step, specifying a position on the endless belt;

a correction amount calculation step for, during the movement of the endless belt, in an error-causing region where a conveyance error is caused by the endless belt, on a basis of the conveyance error, calculating a conveyance correction amount for the endless belt;

a corrected conveyance rate calculation step for adding the conveyance correction amount to a position on the endless belt, the position being related to the error-causing region, to thereby calculate a corrected conveyance rate; and a driving rate calculation step for adjusting a driving rate of the motor according to the corrected conveyance rate; wherein the error-causing region is a region including a position on the endless belt, the position being where a joint of a belt member of the endless belt is brought into abutting contact with any of the pair of rollers or separated from any of the pair of rollers.

5. The method for correction of belt conveyance according to claim 4, wherein the specified position is a position of a marker formed in a location that is on a belt member of the endless belt and has a certain positional relationship with a joint.

* * * * *